US005887770A

United States Patent [19]

Covell

[11] Patent Number: 5,887,770

[45] Date of Patent: Mar. 30, 1999

[54] CONVERTIBLE WAIST PACK, DAY BACKPACK AND SHOULDER BAG

[76] Inventor: John F. Covell, P.O. Box 1030, Warwick, N.Y. 10990

[21] Appl. No.: 24,658

[22] Filed: Feb. 17, 1998

[51] Int. Cl.[6] ..... A45C 13/26; A45F 3/04; A45F 3/14

[52] U.S. Cl. ..... 224/153; 150/102; 224/578; 224/610; 224/614; 224/651; 224/673

[58] Field of Search ..... 224/153, 578, 224/579, 581, 610, 614, 651, 673; 150/102, 110; 190/116; 383/13

[56] References Cited

U.S. PATENT DOCUMENTS

| | | | |
|---|---|---|---|
| 4,273,274 | 6/1981 | Freistadt . | |
| 4,424,841 | 1/1984 | Smith | 190/116 |
| 4,515,300 | 5/1985 | Cohen . | |
| 4,545,414 | 10/1985 | Baum | 224/610 |
| 5,209,384 | 5/1993 | Anderson | 224/651 |
| 5,267,679 | 12/1993 | Kamaya et al. | 224/610 |
| 5,377,887 | 1/1995 | Garcia . | |
| 5,407,112 | 4/1995 | Christodoulou et al. | 224/153 |
| 5,529,229 | 6/1996 | Fier . | |
| 5,540,364 | 7/1996 | Krieger et al. . | |
| 5,577,652 | 11/1996 | Cooper . | |

*Primary Examiner*—Stephen P. Garbe
*Attorney, Agent, or Firm*—Diller, Ramik & Wight, PC

[57] ABSTRACT

A multiple use pack is designed for convenience, security and optimal use of space and structures which can be sued as a waist pack, a day backpack or a shoulder bag. A back face of the waist pack slides by means of a long belt loop on a removable, adjustable belt with quick release buckles allowing the waist pack to serve as a fanny pack/belly pack. The waist pack converts into a day backpack by opening a zippered main compartment posterior to the waist pack's main storage compartment. The zipper is stopped by a strip of fabric located in the middle bottom of the waist pack's main storage compartment connected to the middle bottom of the back face of the waist pack. The connecting fabric strip becomes a combined zipper stop and weight-bearing hinge which keeps the zipper slider from being pulled apart by the weight of items stored in the pack when used in the day backpack mode. Most importantly the fabric strip becomes a hinge which allows the back face of the waist pack to become the bottom of the day backpack and the waist pack main storage compartment to become an anterior storage compartment for the day backpack.

46 Claims, 10 Drawing Sheets

Fig. 2
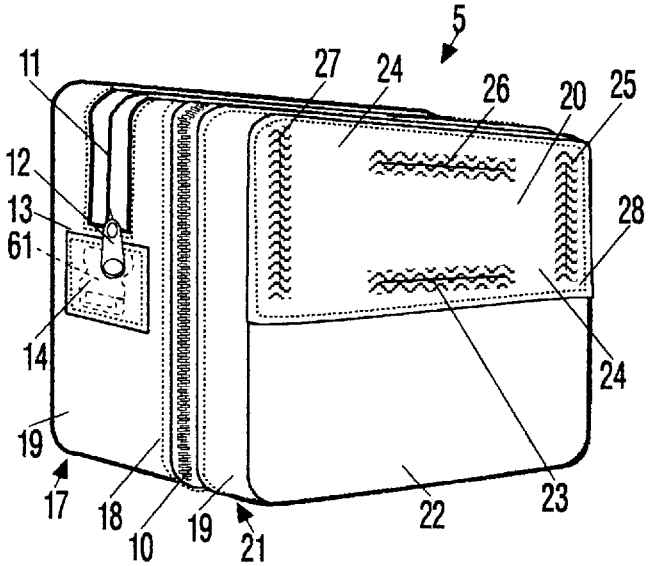
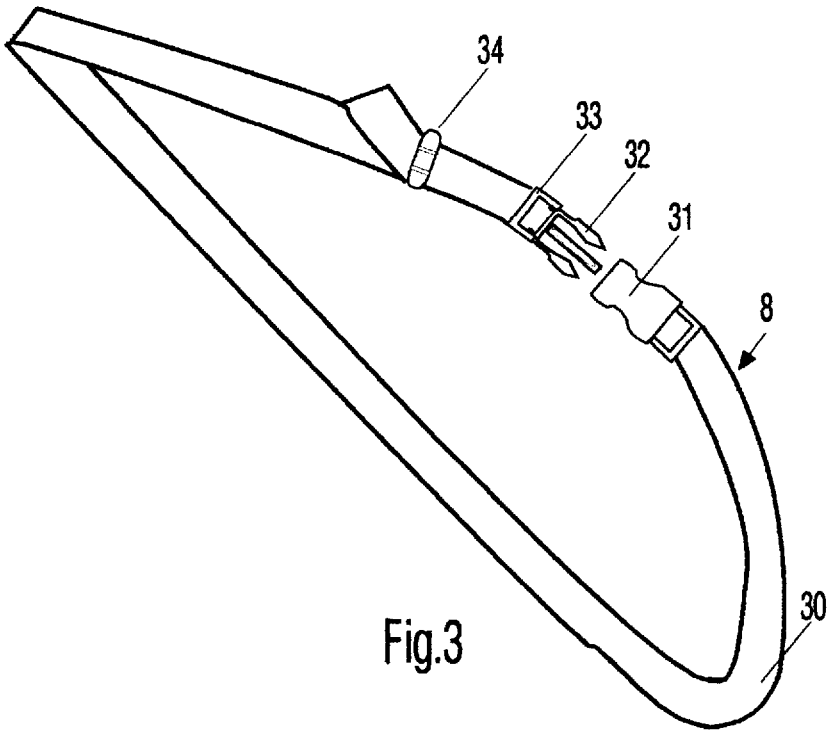
Fig.3

Fig. 9
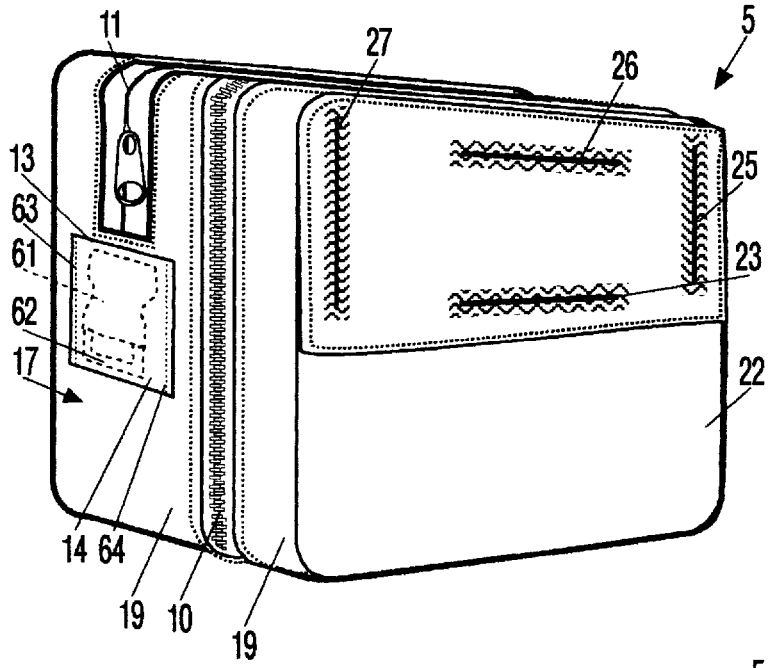
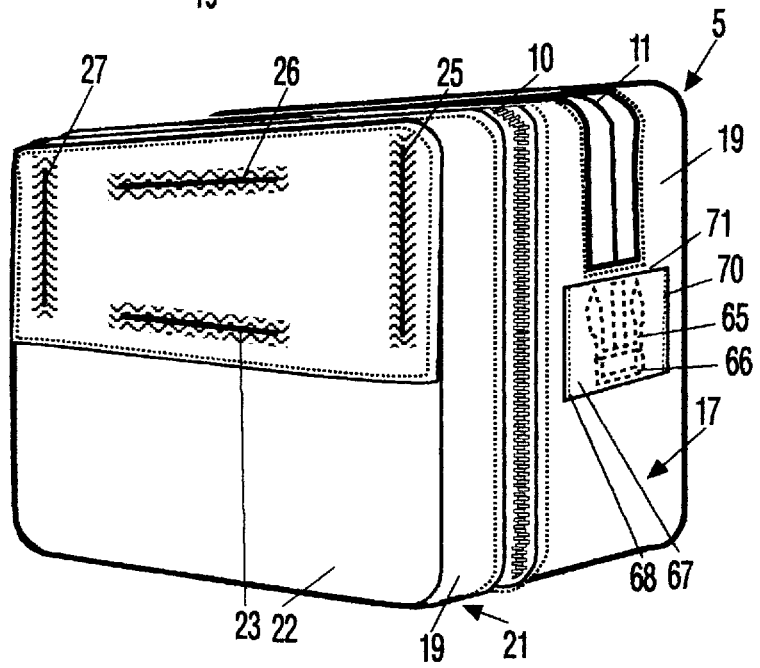
Fig. 10

CONVERTIBLE WAIST PACK, DAY BACKPACK AND SHOULDER BAG

DESCRIPTION OF PRIOR ART

When shopping or traveling as a tourist it is advantageous to travel without encumbering hands. Hands free travel allows for greater awareness of the surroundings and flexibility of movement. Waist packs, shoulder bags and backpacks are common solutions to this challenge. They can conveniently be checked through customs or taken on airplanes. Some situations are more appropriate for a waist pack worn as a fanny pack (climbing steep steps) or a waist pack worn as a belly pack (in an airplane seat). Some people are more comfortable with a shoulder bag. Shoulder bags are more appropriate for some situations and more secure (the restroom of a busy airport). There are other situations where a day backpack that has a larger carrying space than a waist pack or shoulder bag would be very convenient. If you start the day with a waist pack or shoulder bag and purchased items along the way, a day backpack would allow you to continue the trip with hands free mobility and flexibility. The best solution for mobility and flexibility when traveling would be a waist pack that could be worn as a fanny pack or belly pack, would conveniently convert to a shoulder bag and conveniently convert to a day backpack designed with security consciousness in all of the above modes.

Prior Art showing various attempts to convert a bag into different styles:

For an example, U.S. Pat. No. 4,515,300 discloses a combination bike bag, shoulder bag, belt bag and backpack. The patent makes no attempt to secure the shoulder bag from theft by unsnapping one of the side straps. The bag would have to be made from very rigid material, not standard waist pack/backpack material, because it has only two belt loops. Rigid material would be necessary to keep the bag from sagging or bunching up on the waist belt from the weight of the bag. The bag is a backpack rather than a day backpack design. A compartment is unzipped and the backpack is pulled out of the compartment. This hideaway backpack does not integrate all the original surfaces of the shoulder bag into the backpack. The backpack is not dependent upon the other surfaces of the shoulder bag/belt bag, and the backpack storage decreases the effectiveness of the shoulder bag and waist bag because of the space needed to store the entire backpack. The waist attachment strap stays a waist attachment with a waist belt. A waist belt is unnecessary for a day backpack.

U.S. Pat. No. 5,540,364 discloses a fanny pack carrier for a harness. The harness expands from the fanny pack. The purpose of the harness is to secure the carrying platform for heavy or clumsy items. The harness can carry skis or have a backpack strapped into the harness. The backpack is not carried inside the fanny pack and is a separate application. With all the heavy duty straps and belt and permanent waist belt it cannot function as a waist pack or day backpack. It has no conversion to a shoulder bag.

U.S. Pat. No. 5,577,652 discloses a shoulder bag that may be worn as a backpack across the chest. Conversion to the three modes is accomplished by manipulation of an adjustable strap into various buckles. The backpack stays the same size as the shoulder bag or chest bag. It has no special security considerations in the design. In the backpack mode this backpack would tend to slide from one side to another on the backpack strap. The loop at the top of the pack through which the backpack strap slides does not anchor the backpack to one place on the strap allowing the backpack to slide on the strap.

U.S. Pat. No. 5,377,887 discloses a hand carried luggage bag that has a shoulder strap and converts into a backpack. It is not a waist or fanny pack. The luggage pack stays the same size as the backpack. Conversion to backpack is by means of contained shoulder straps.

U.S. Pat. No. 4,273,274 discloses a handbag that converts to a backpack. The handbag straps become the backpack straps. The handbag and backpack stay the same size. Thee is no conversion to a waist pack or a single strap shoulder bag.

U.S. Pat. No. 5,529,229 discloses a backpack with retractable shoulder and waist straps. It does not function as a waist pack or shoulder bag.

SUMMARY OF THE INVENTION

The invention is a pack which is fully functional as a waist pack, shoulder bag or day backpack under the following considerations:

(a) the pack converts easily from any one mode (waist pack/shoulder bag/day backpack) to any other of the said modes;

(b) the pack is quick to convert to any of the modes;

(c) each fully functioning mode does not infringe on the space, surfaces or usage of any of the other modes;

(d) the pack utilizes all spaces and surfaces to actualize the utility of all modes (waist pack, shoulder bag or day backpack);

(e) the pack is a functional size in any mode (waist pack, shoulder bag or day backpack);

(f) the pack impedes theft and furnishes security to the items carried in any mode;

(g) the pack functions exceed the utility of any other convertible pack in the waist pack, shoulder bag or day backpack mode;

(h) the pack in any of its modes competes favorably with the utility of conventional packs which are designed specifically as waist packs, shoulder bags or day backpacks;

(i) the pack could be worn as a waist pack, a fanny pack or a belly pack; and (j) as a day backpack it would not be encumbered with a waist belt which is unnecessary for a day backpack.

BRIEF DESCRIPTION OF THE DRAWINGS

FIG. 2 is a rear perspective view of the pack, and illustrates the same in the waist pack/shoulder bag mode of FIG. 1 without waist belt/shoulder strap.

FIG. 3 is a perspective view of the waist belt/shoulder strap, and illustrates cooperative strap fasteners.

FIG. 9 is a rear perspective view of the pack, and illustrates a female buckle component covered by a security strip.

FIG. 10 is a rear perspective view of the pack, and illustrates a male buckle component covered by a security strip at an end of the pack opposite the pack end shown in FIG. 9.

DESCRIPTION OF THE PREFERRED EMBODIMENTS

Figure 1:
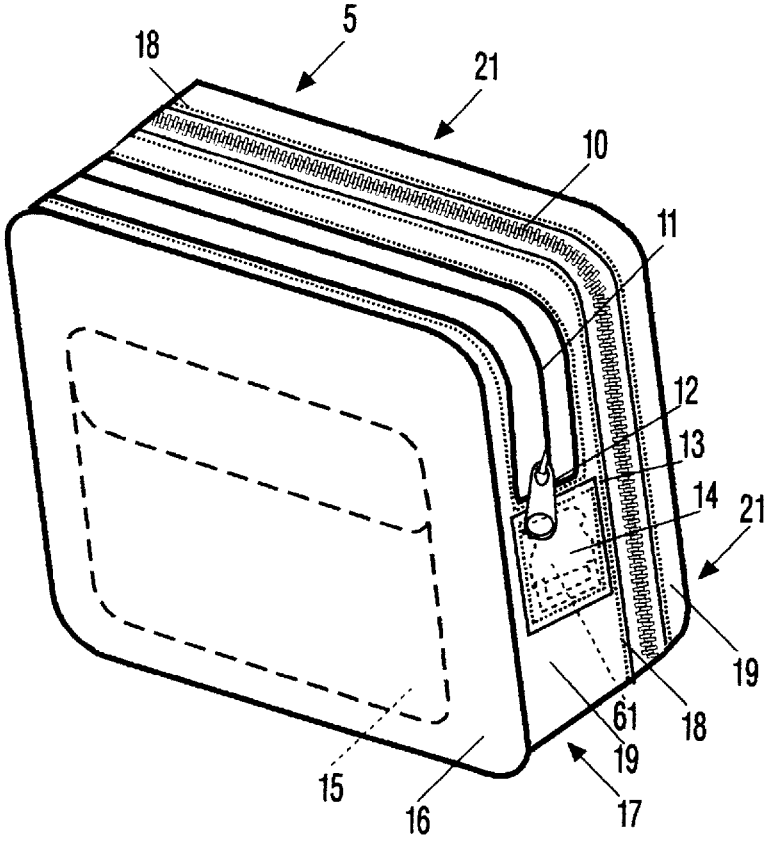
FIG. 1 is a front perspective view of a pack, and illustrates the same in waist pack/shoulder bag mode without waist belt/shoulder strap.

A novel pack 5 in waist pack/shoulder bag mode without an associated waist belt/shoulder strap 8 is shown in FIGS. 1 and 2 of the drawings.

Figure 6:
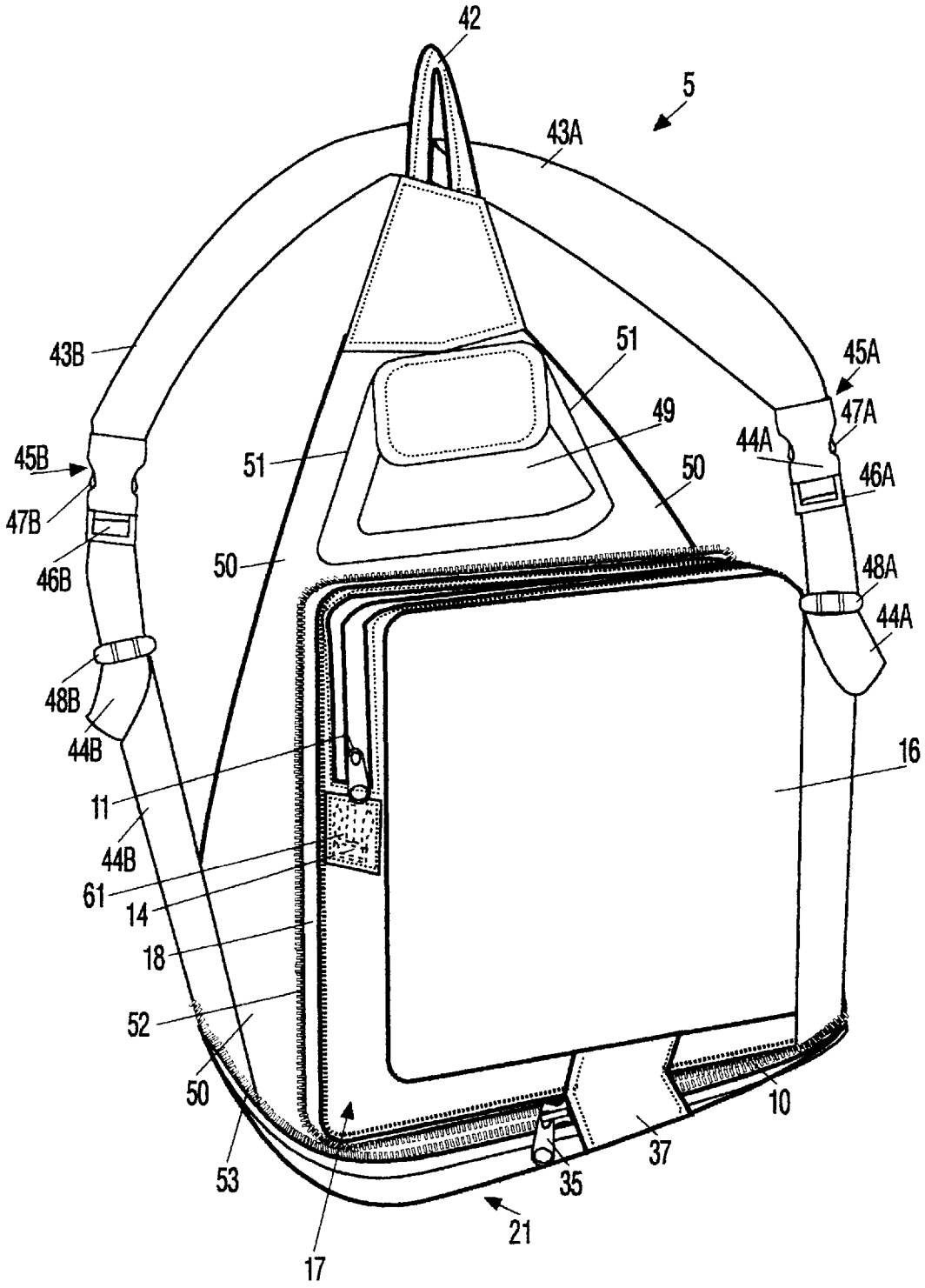
FIG. 6 is a perspective view, and illustrates a day backpack expanding from an interior compartment of the unzipped pack.
Figure 7:
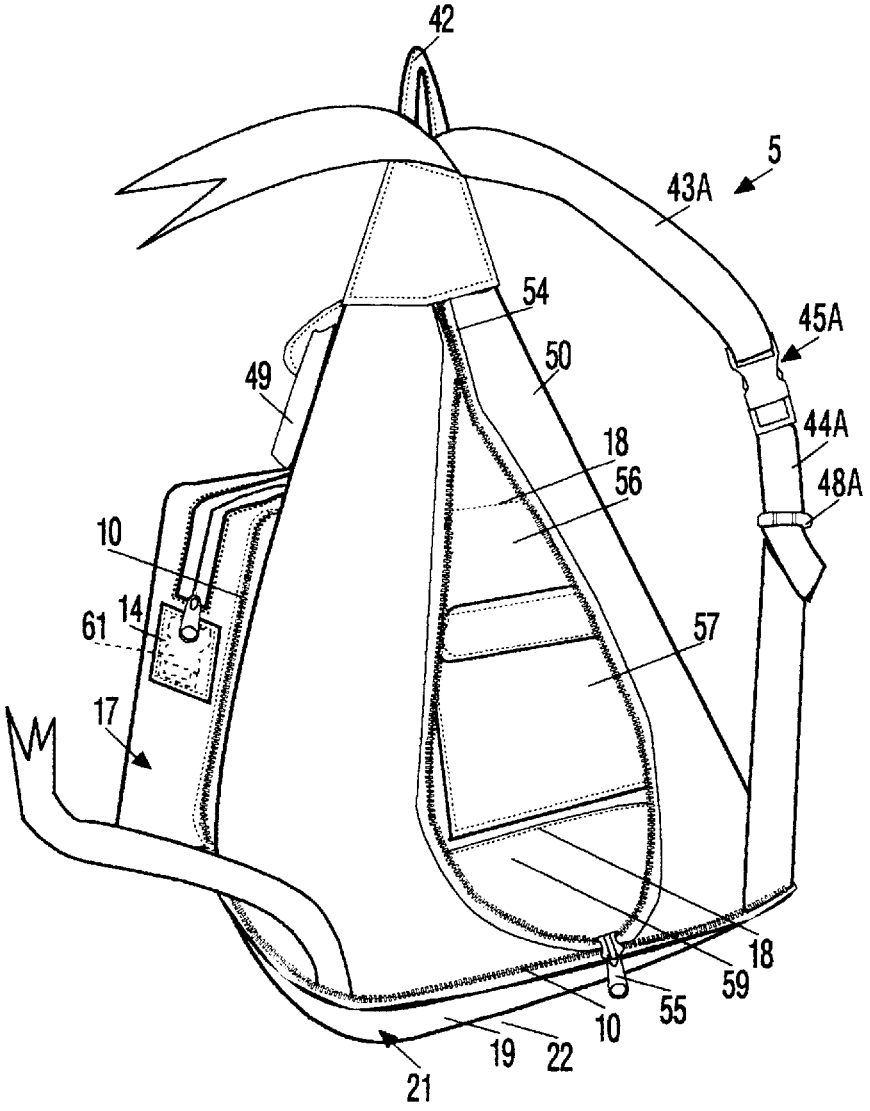
FIG. 7 is a perspective view of the day backpack, and illustrates the side towards a wearer's back and several security compartments thereof.

The pack 5 includes a zipper 10 to open a day backpack compartment 59 (FIG. 7). A zipper 11 opens a main storage compartment 17 (FIGS. 6 through 11) for waist pack or shoulder bag mode. A zipper slider 12 is attached to the zipper 11. An upper facing opening 13 is formed by a left cloth security strip 14 sewn to the pack 5 which encloses a standard female component 61 of quick release buckle (See FIGS. 1, 2, 4, 6, 7, and 9). The enclosed female buckle 61 can be attached to a standard male component 32 (FIG. 3) of quick release buckle of a waist belt/shoulder strap 8 when the pack 5 is used in the shoulder bag mode.

An internal pocket 15 is housed inside the main storage compartment 17 for waist pack or shoulder bag mode. Internal pocket 15 is one example of a variety of compartments or pockets which can be housed inside the main storage compartment 17 for waist pack or shoulder bag mode. A front face 16 of the pack 5 (FIGS. 1, 5, and 6) may be imprinted with designs, or additional storage compartments may be attached to front face or front wall 16.

The main storage compartment 17 for waist pack/shoulder bag mode extends from the stitching 18 to the front face 16 and includes everything inside and outside the compartment, namely the zipper 11, the zipper slider 12, the left security strip 14, the internal pocket 15, the front face 16, and the stitching 18. The stitching 18 defines an internal wall or partition dividing surface 56 (see FIG. 7) separating the entire main storage compartment 21. The day backpack compartment 21 also includes the stitching 18 and everything posterior of the stitching 18 in the waist pack/shoulder bag mode. The main storage compartment 17 also includes the stitching 18 and everything anterior of the stitching 18.

Figure 8:
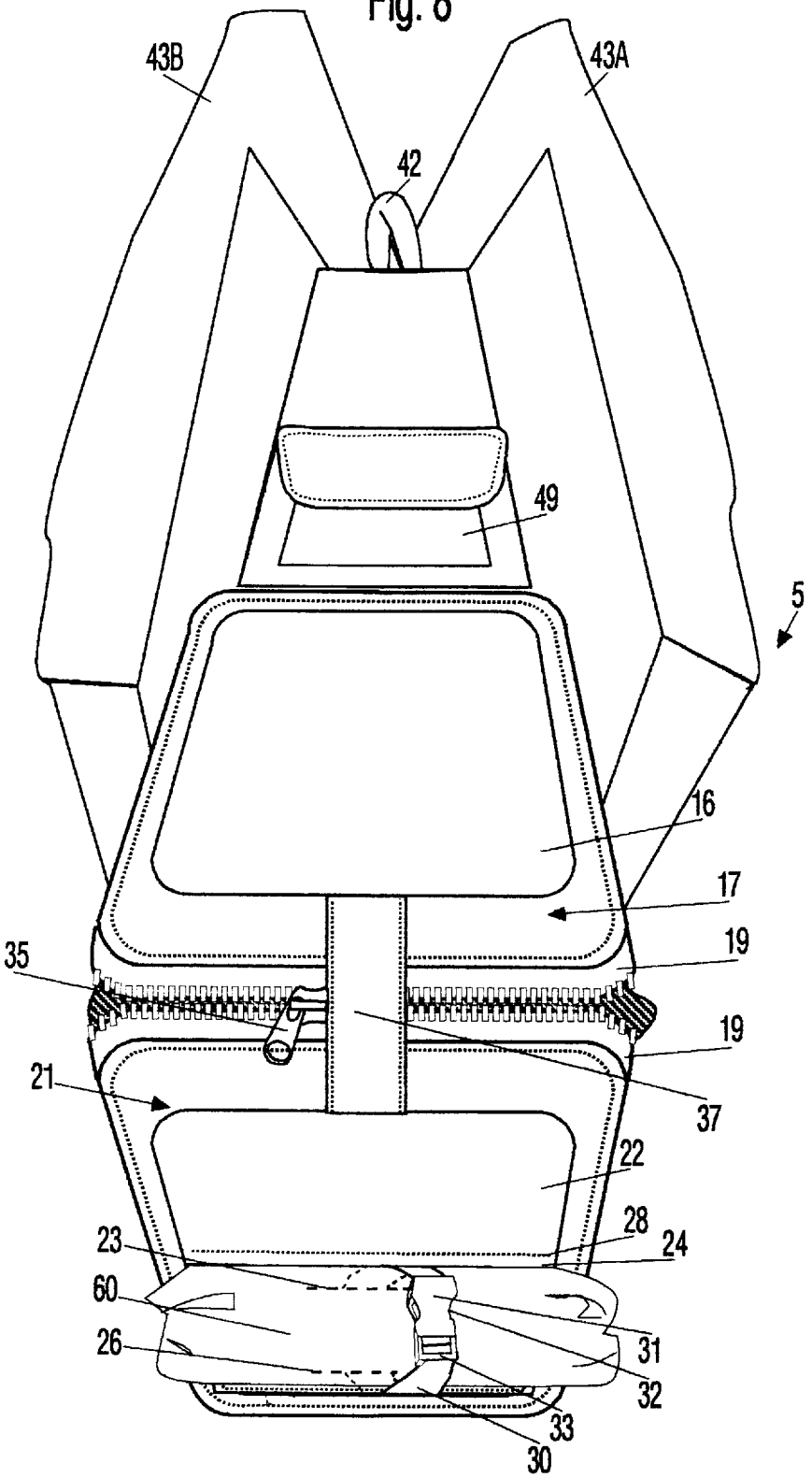
FIG. 8 is a bottom perspective view of the pack and illustrates a carry item attached to a bottom of the day backpack with the waist belt/shoulder strap secured through lashing slots of the pack.

A rear face or rear wall of the pack 5 (FIGS. 7 to 11) is a rear of the day backpack compartment 21. The zipper 10 extends substantially entirely around a peripheral wall 19 which is disposed between the front wall 16 and the rear wall 22. In the waist pack/shoulder bag mode, the rear face 22 is disposed towards the body of the person wearing the pack 5. In the day backpack mode the rear face 22 of the pack 5 becomes the bottom of the day backpack mode (see FIG. 5). A rectangular fabric or panel 24 is attached at the top across the width of the rear face 22 by stitching 28. A lashing slot 23 and a lashing slot 26 are slots in the rectangular fabric 24. The lashing slots 23 and 26 are used to lash, tie or attach carry items to the bottom of the pack 5 in the day backpack mode see (FIG. 8). Waist belt slots 25 and 27 are parallel to each other and at right angles to lashing slots 23 and 26. The waist belt slot 25 and the waist belt slot 27 receive the waist belt 8 when the pack 5 is in the waist pack mode. The stitching 28 around an edge (unnumbered) of rectangular fabric 24 attaches the fabric 24 to the top of the rear face 22 of the pack 5. When pack 5 is in the waist pack/shoulder bag mode, fabric 24 with the waist belt slots 25 and 27 form one continuous belt loop 20 along the entire width of the rear face 22 (see FIG. 4). The belt loop 20 is formed from the rectangular fabric 24, the belt slot 25 and the belt slot 27 into one long continuous belt loop. The weight of the pack 5 is thereby distributed along the top of the stitching 28, along the top of the long belt loop 20, and along the waist belt 8 (see FIG. 4). The long belt loop 20 furnishes support to maintain the shape of the waist pack 5. If the pack 5 is made of light, supple material and the waist belt 8 passes through standard spaced belt loops, the pack would tend to bunch up or sag when the pack was carrying weight.

In addition, the lashing slots 23 and 26 in the fabric 24 allow a user the opportunity to lash, tie or attach additional carry items to the pack 5 when pack 5 is in the day backpack mode utilizing the waist belt/shoulder strap 8 or conventional rope. The slots 23, 25, 26 and 27 can all be used to tie items to the bottom of the pack 5 in the day backpack mode or lash the pack 5 when in the waist pack/shoulder bag mode to a bike.

The waist belt/shoulder strap assembly 8 is belt material 30, such as fabric, which would match the material or fabric of the pack 5. A conventional female component or connector 31 of a quick-release buckle is attached to one end of the belt material 30. The belt material 30 is sewn or riveted to the female buckle component 31. The other end of the belt material 30 is woven through an end of a conventional male connector or component 32 of a quick-release buckle. The length of the waist belt/shoulder strap 8 is adjusted by a conventional strap length adjustment 33 in which the belt material 30 is threaded through the male component 32 of the quick-release buckle. When shortening the waist belt/shoulder strap 8, a standard strap keeper 34 keeps excess belt material 30 from dangling and provides an aesthetic appearance.

Figure 4:
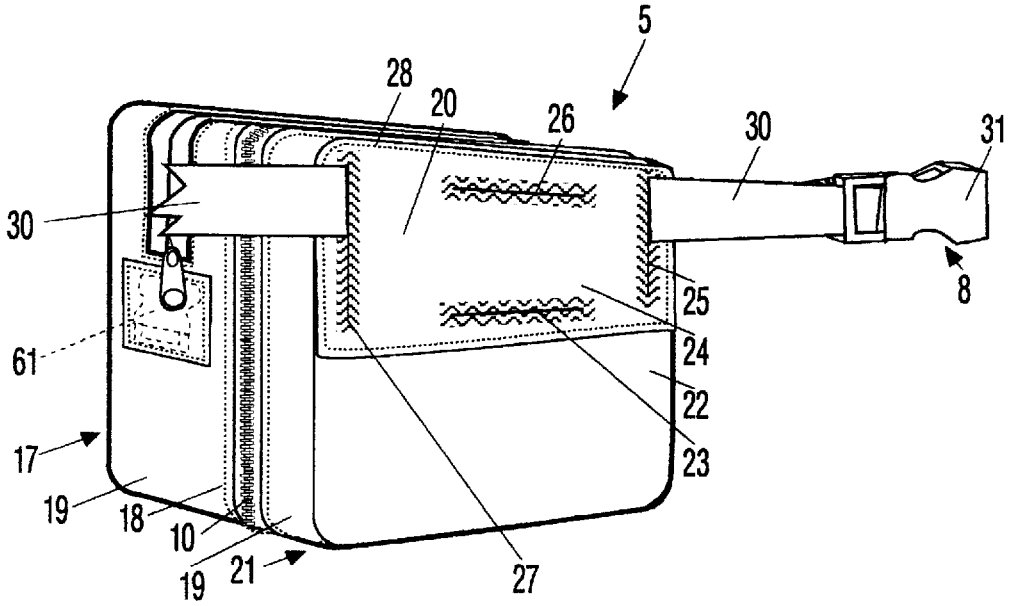
FIG. 4 is a rear perspective view of the pack in the waist pack mode, and illustrates the waist belt/shoulder strap of FIG. 3 engaged as a waist belt.

In FIG. 4 the waist belt fabric 30 is inserted in the waist belt slot 25 and emerges from between the rear face 22 of the pack 5 and the rectangular fabric strip 24 at the other waist belt slot 27. The stitching 28 attaches the rectangular fabric or panel 24 to the rear face 22 of the pack 5 and forms one long belt loop 20 which distributes the weight of the pack along the belt 8 between the waist belt slots 25 and 27. This allows the waist belt 8 to carry the pack without the pack 5 sagging or bunching on the strap 8 even when the pack 5 is weighted.

Figure 5:
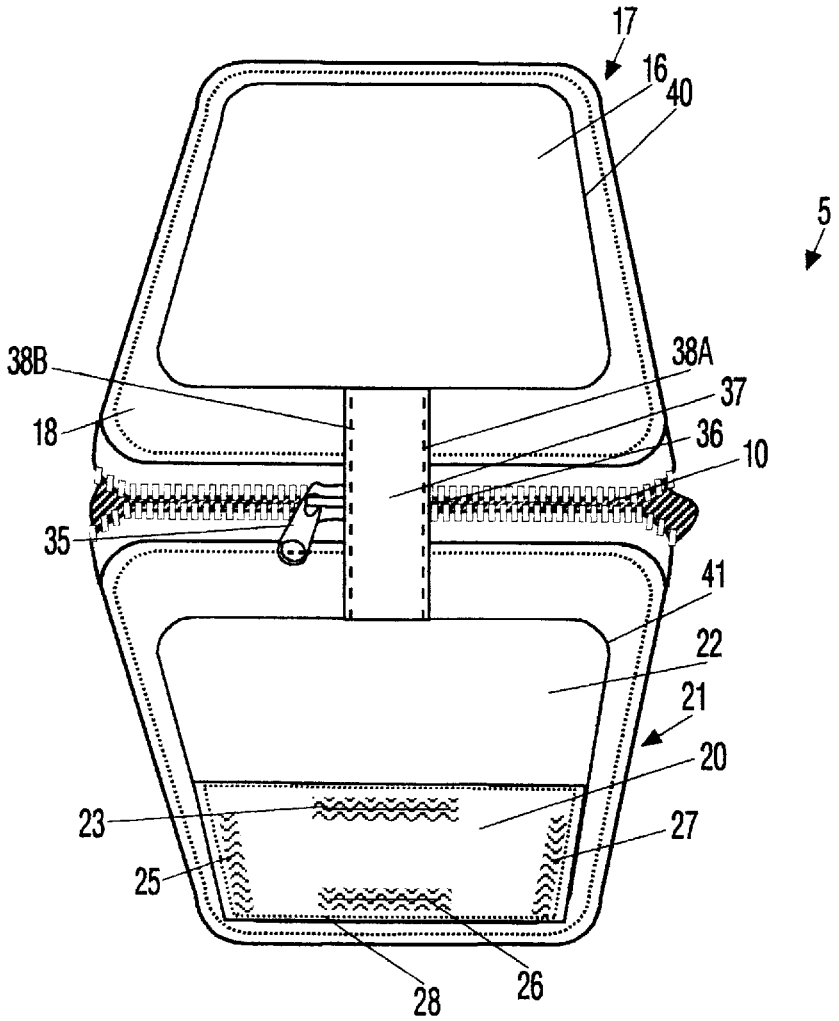
FIG. 5 is a bottom perspective view of the waist pack/shoulder bag without the strap in conversion to day backpack, and illustrates a zipper stop and weight-bearing hinge.

A zipper slider 35 (FIGS. 5, 6, and 8) is connected to the zipper 10. When the pack 5 is in the waist pack/shoulder bag mode, the zipper 10 is closed (FIGS. 9 and 10). When converting the pack 5 from waist pack/shoulder bag mode to day backpack mode, the zipper 10 is unzipped (FIGS. 5 to 7) and the slider 35 of the zipper 10 is stopped by a zipper stop weight-bearing hinge 37 (FIG. 5). The zipper stop weight-bearing hinge 37 is a rectangular piece of fabric which is attached by stitching 38A and stitching 38B to a bottom (unnumbered) of the main storage compartment 17 of the pack 5. One end (unnumbered) of the zipper stop weight-bearing hinge 37 is stitched-under the front face 16 of the pack 5 by a stitched or stitching seam 40 and the other end under the rear face 22 of waist pack/shoulder bag mode and the rear face of day backpack compartment 21 by a stitched or stitching seam 41.

When the pack 5 is converted to day backpack mode, the zipper 10 is unzipped by moving the zipper slider 35 from the closed zipper position (FIGS. 1, 2, 4, 9 and 10) at an edge of the zipper stop weight-bearing hinge 37 around day backpack compartment 21 to the other side of zipper stop weight-bearing hinge 37 (FIGS. 5 through 8). The front face 16 of the pack 5 in the waist pack/shoulder bag mode is then moved to a right angle of the rear face 22 of waist pack/shoulder bag. The rear face 22 now becomes the bottom of a main day backpack storage compartment 50 (see FIG. 6) and the main storage compartment 17 in the waist pack/shoulder bag mode of the pack 5 becomes an anterior storage compartment of the day backpack mode. The rear face 22, now the bottom in the day backpack mode, is connected to the main storage compartment 17 which is now the anterior storage compartment for the day backpack mode by the zipper stop weight-bearing hinge 37. The rear face 22 and the front face 16 of the storage compartment 17 can be moved at right angles to each other as the zipper stop weight-bearing hinge 37 bends and serves as a hinge. The zipper stop weight-bearing hinge 37 will bear the weight of the loaded day backpack and prevent the zipper 10 from being pulled apart from zipper slider 35 by the weight of the day backpack.

A coat hanger loop 42 is provided the pack 5 for the day backpack mode (FIGS. 6, 7 and 8). Comfort straps 43A and 43B are made from fabric strap material which is wider than the adjustable strap 44A and 44B of the day backpack mode. Conventional quick release buckles 45A and 45B (FIG. 6) with conventional strap length adjustment members 46A and 46B, respectively, are provided for adjusting day backpack straps 44A and 44B. The point of length adjustment for the members 46A, 46B is on the male component of conventional quick release buckles 47A and 47B, respectively. Conventional strap keepers 48A and 48B keep excess adjustable strap 44A and 44B from dangling. A storage compartment 49 for the day backpack mode is sewn to main compartment 50 of pack 5 in the day backpack mode by stitching or a stitched seam 51.

An anterior half 52 of the zipper 10 which is attached by stitching 18 to the main storage compartment 17 in the waist pack/shoulder bag mode is part of an anterior compartment for the day backpack mode. Another posterior half 53 of the zipper 10 is attached to day backpack compartment 21 and is located at the edge of the bottom of the pack 5 in the day backpack mode. only the edge of the rear face 22 of the waist pack/shoulder bag mode of the pack 5 is shown in FIGS. 5 and 6. The rear face 22 of the pack 5 is now the bottom of the main day backpack compartment 50 (FIGS. 6 and 8). The zipper stop weight-bearing hinge 37 bends when the zipper 10 is open and allows the day backpack components, namely, the coat loop hanger 42, the comfort shoulder straps 43A and 43B, the adjustable straps 44A and 44B, the quick release buckles 45A and 45B, the conventional strap keepers 48A and 48B, the storage compartment 49, and the main day backpack compartment 50 to expand from the day backpack compartment 21. The zipper stop weight-bearing hinge 37 connects the rear face 22 of the day backpack compartment 21 to the main compartment 17 of the waist pack/shoulder bag compartment. When the main compartment so of the day backpack is loaded with carry articles, it can exert a force on the rear face 22 that is now the bottom of the day backpack. This weight would pull the zipper slider 35 apart from zipper 10 if zipper stop weight-bearing hinge 37 did not carry the weight.

A zipper 54 (FIG. 7) of the day backpack main compartment 50 is opened by gripping and pulling a zipper slider 55, revealing part of the stitching seam 18. Stitching seam 18 attaches the main compartment 50 of the day backpack to the main storage compartment 17 of the waist pack/shoulder bag mode. A security pocket 57 (FIG. 7) is located inside the main compartment 50 of the day backpack. A stitched seam or stitching 58 attaches security pocket 57 to the inside surface of the main compartment 50 of the day backpack and the posterior wall of the main storage compartment 17 of the waist pack/shoulder bag. The security pocket 57 is protected from being cut with a razor, as might otherwise be attempted by a thief, by the structure of the main storage compartment 17 of the waist pack/shoulder bag. This security pocket 57 had additional security because the main compartment 50 of the day backpack can be unzipped by the zipper 54 which is located facing towards the back of the wearer. The security pocket 57 can be used in day backpack mode or as an inner security pocket in the waist pack/shoulder bag mode when the day backpack components are collapsed back into day backpack compartment when in waist pack. or shoulder bag modes. The stitching or stitched seam 18 attaches the main compartment 50 of the day backpack to the main storage compartment 17 of the waist pack/shoulder bag forming an anterior divider wall or partition 56. The anterior divider wall 56 of the main compartment 50 of the day backpack would be a posterior wall, divider partition to the main storage compartment 17 of the waist pack/shoulder bag.

An additional carry item 60 is shown in FIG. 8 as an example of an item carried on the bottom of the day backpack by using a conventional rope or, as shown, utilizing the waist belt/shoulder strap 8 inserted through the lashing slots 23 and 26. The male component 32 of the conventional quick release buckle is inserted in the lashing slot 23 under the rectangular fabric 24 and out through the lashing slot 26, and is snapped into the conventional female component 31 of the quick release buckle causing the belt material 30 to encompass the carry item 60. If the strap material 30 is too loose to secure the carry item 60 to the bottom of the day backpack, the strap material 30 can be wrapped around the carry item 60 or the length of strap material 30 can be shortened by the strap length adjustment member 33 of the male component 32 of the conventional quick release buckle.

The conventional female component 61 of a conventional quick release buckle is sewn to the side of the pack 5 and is used to attach one end of the shoulder straps 43A and 43B in the shoulder bag mode (FIG. 9) as was described briefly earlier herein. The female component 61 is sewn to the main storage compartment 17 by a rear bar 62 of the female component 61. The female component 61 is covered by the rectangular piece of fabric or left security strip 14 which is stitched to the main storage compartment 17 by vertical stitches 63 and 64. Left security strip 14 is not stitched horizontally to main storage compartment 17. Therefor, left security strip 14 is not stitched across the top and thereby defines the opening 13. The opening 13 is an opening between the main storage compartment 17 of the waist pack/shoulder bag and the left security strip 14 The opening 13 allows the male component 32 of the waist belt/shoulder strap 8 as a shoulder strap in the shoulder bag mode. The purpose of the left security strip 14 is to impede unauthorized attempts by a thief to detach the shoulder strap 8 from the shoulder bag and steal the shoulder bag. The left security strip 14 also improves the aesthetic appearance of the pack 5 by covering the unattached female component 61 (FIGS. 1, 2, and 6). The left security strip 14 also prevents the female component 61 from being damaged or ripped off the pack 5.

Figure 11:
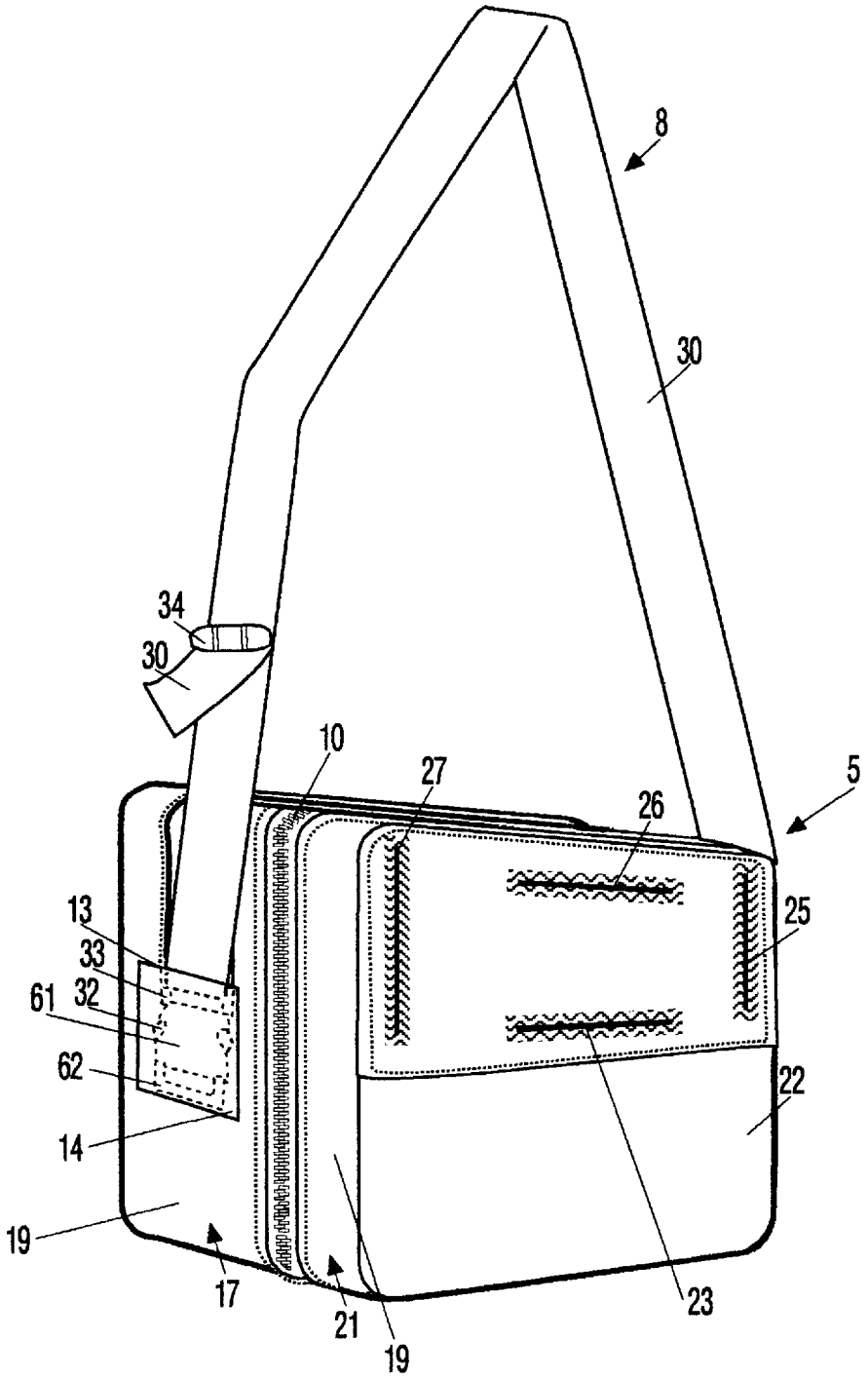
FIG. 11 is a perspective view of the pack and illustrates a waist belt/shoulder strap attached in the shoulder bag mode of the pack.

A standard male component 65 (FIG. 10) of a quick-release buckle is sewn to the side of the main storage compartment 17 opposite the female component 61. The male component 65 (FIG. 10) of the quick-release buckle is sewn to the main storage compartment 17 at a rear bar 66 of the male component 65. The male component 65 is covered by a rectangular piece of fabric or right security strip 67. The right security strip 67 is stitched to the main storage compartment 17 by vertical stitching 68 and 70 (FIG. 10). There is no horizontal stitching on the right security strip 67 leaving an opening 71 between the right security strip 67 and the main storage compartment 17. The opening 71 allows the female component 31 (FIG. 3) of the waist belt/shoulder strap 8 to connect with the male component 65 of the quick-release buckle to form one end of a shoulder strap for the shoulder bag mode (FIG. 11). The purpose of the right security strip 67 is to impede the detachment of the shoulder strap 8 from the shoulder bag mode (FIG. 11) should a thief attempt to steal the shoulder bag, as well as to protect the buckle components from damage and improve the aesthetic appearance of the pack 5.

Figure 12:
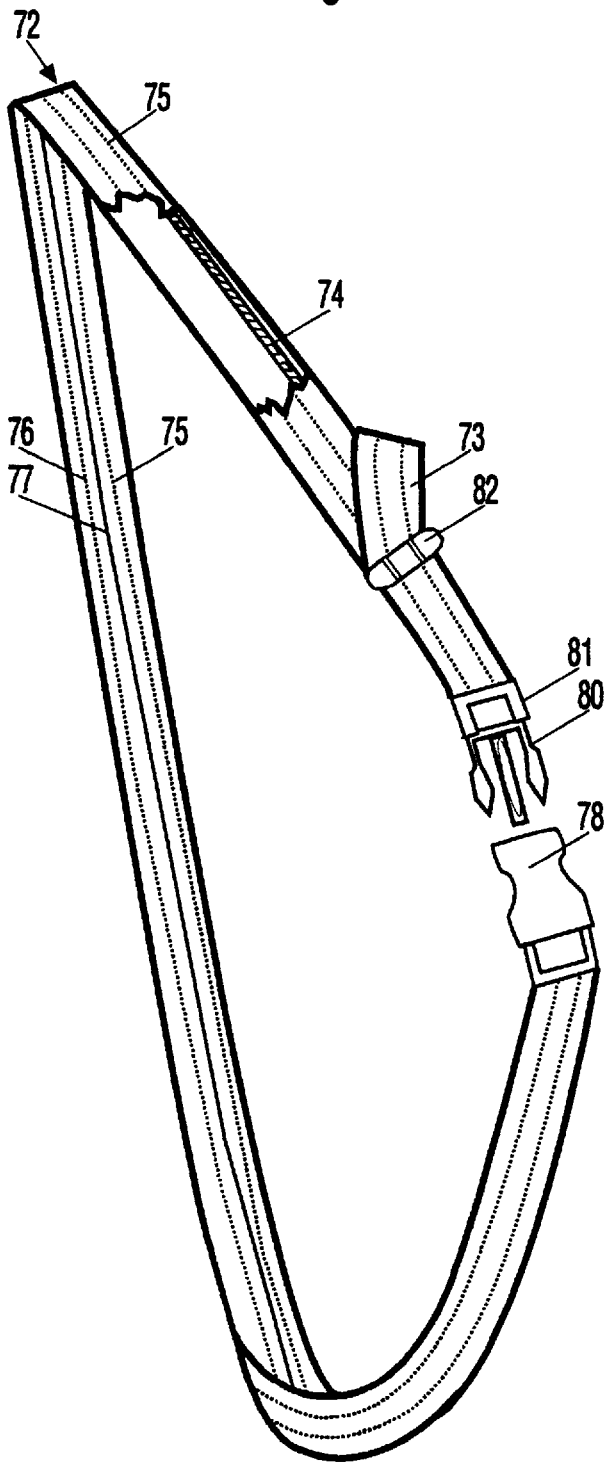
FIG. 12 is a perspective view of a waist belt/shoulder strap, and illustrates a steel security cable therein.

A stainless steel security cable 74 (FIG. 12) is housed within belt material 73 of another waist belt/shoulder strap 72 along one edge of the waist belt/shoulder strap 72. The edges of the belt material 73 of the waist belt/shoulder strap 72 meet on the inside of the waist belt/shoulder strap 72 at a location represented by a line 77. Stitched seams 75 and 76 secure the belt material 73 of the waist belt/shoulder strap 72. A conventional female component 78 of a quick-release buckle is attached by sewing or riveting to one end of the belt material 73. The other end of belt material 73 is woven through the end of a conventional male component 80 of a quick-release buckle. The length of the waist belt/shoulder strap 72 is adjusted at the point at which the belt material 73 is threaded into a conventional strap length adjustment member 81 of the male component 80 of the quick-release buckle 80. A strap keeper 82 keeps excess belt material when shortening the waist belt/shoulder strap 72. The strap keeper 82 keeps excess strap from dangling and provides an aesthetic appearance.

OPERATION

Waist Pack Mode (FIGS. 1, 2, 3, 4, 5, and 10)

Conversion of the pack 5 to the waist pack mode is accomplished by threading the waist belt/shoulder strap 8 (or 72) through the waist belt slots 25 and 27 (shown in FIG. 4). The length of the belt material 30 is adjusted at the strap length adjustment member 33, and excess strap is secured in the strap keeper 34 (FIG. 3). In the waist pack mode (FIG. 4) the pack will slide on the waist belt 8 to the most comfortable and suitable location for the situation. The pack 5 can be positioned as a fanny pack when climbing long steep stairs, as a belly pack in an airplane seat or waist pack when shopping in the market. Additional security for the waist pack may be acquired by sliding the waist belt quick-release buckle components 31, 32 under the waist pack and within the loop 20, preventing a thief from unsnapping the components 31, 32 and stealing the pack 5.

Shoulder Bag Mode (FIG. 11)

Conversion to shoulder bag mode is accomplished by snapping the male component 32 of the quick-release buckle of the shoulder strap 8 (or 72) into the female component 61 of the quick-release buckle which is attached to the wearer's left side of the pack 5. The female component 31 of the quick-release buckle (FIG. 3) is snapped into the male component 65 of the quick-release buckle (FIG. 10). Each of the snapped quick-release buckles are covered with their respective rectangular pieces of fabric or security strips 14, 67 (FIGS. 9 and 10).

Day Backpack Mode (FIGS. 6, 7, and 8)

Conversion to day backpack mode is accomplished by unzipping zipper 10 (FIG. 5) and releasing some of the components for the day backpack mode (FIG. 6), such as the comfort shoulder straps 43A and 43B; the adjustable straps 44A and 44B; the quick-release buckles 45A and 45B; the hanger loop 42; the storage compartment 49; and the main day backpack storage compartment 50 from the day backpack compartment 21. When the zipper 10 is unzipped, its slider 35 is stopped by the rectangular piece of fabric, zipper stop and/or weight-bearing hinge 37. The zipper stop weight-bearing hinge 37 allows the pack 5 in the day backpack mode to function as a fully functioning day backpack and the waist pack to function as a fully functioning waist pack and the shoulder bag to function as a fully functioning shoulder bag with large usable areas, surface and space without infringing on the utility of any of the other modes. In the day backpack mode the zipper stop and weight-bearing hinge 37 will bend so that the rear face 22 of the waist pack/shoulder bag is at an approximate 90 degree angle to the main storage compartment 17 for the waist pack/shoulder bag. The rear face 22 of the waist pack/shoulder bag now functions as the bottom of the day backpack and the bottom of the main compartment 50 of the day backpack. The main storage compartment 17 for the waist pack/shoulder bag now becomes an anterior storage compartment for the day backpack mode. When the anterior storage compartment of the day backpack and the main compartment are loaded with carry items, they exert a downward force. The zipper stop and weight-bearing hinge 37 stops the slider 35 of the zipper 10 and bears the weight of said compartments preventing the load force from pulling zipper 10 apart from slider 35.

The day backpack is a fully functioning day backpack with many convenience features possible (FIG. 6), such as wide comfort shoulder straps 43A and 43B, adjustable straps 44A and 44B, quick-release buckles 45A and 45B, a strap keeper 47 for excess strap, a storage compartment 49 and coat rack loop 42. The main compartment 50 of the day backpack opens inward toward the wearer's back as an extra security feature preventing the main day backpack compartment being opened unnoticed. This doesn't interfere with use of the main compartment because nobody opens the main compartment of a day backpack while it is on their back. The security pocket 57 is located behind the main storage compartment 17 of the waist pack/shoulder bag and inside the main compartment 50 of the day backpack. This location protects the security pocket 57 from being cut open by a thief with a razor. The security pocket 57 can be used in the day backpack mode or when the day backpack is collapsed in the waist pack or shoulder bag modes.

The bottom of the day backpack serves as an additional carry surface (FIG. 8). Carry items can be lashed to the bottom of the day backpack with rope or the waist belt/shoulder strap 8 through the lashing slots 23 and 26. The lashing slots 23 and 26 can be used to tie or attach carry items such as a jacket or small duffle bag in conjunction with the belt slots 25 and 27 (FIG. 2). The lashing slots 23 and 26 and the belt slots 25 and 27 could also be used with the waist belt/shoulder strap 8 to attach the waist pack/shoulder bag to a bike.

What is claimed is:

1. A pack convertible into at least one of a waist pack, a day backpack and a shoulder bag mode of operation comprising front and rear walls and a peripheral wall joining said front and rear walls, said walls in part defining an interior storage compartment, said peripheral wall including a bottom wall portion, zipper means for opening and closing said peripheral wall substantially along the entire peripheral extent thereof, means at a central portion of said bottom wall portion for hinging together said front and rear walls, said hinge means being constructed and arranged to function as a weight bearing support in the day backpack mode of said pack, and strap means for supporting said pack in at least one of said operative modes.

2. The convertible pack as defined in claim 1 wherein said peripheral wall includes a top wall portion and spaced opposite end wall portions disposed between said top wall portion and said bottom wall portion, coupling means for connecting a strap end to each of said end wall portions, and security means for preventing unauthorized access to said coupling means thereby deterring theft of said pack in the shoulder bag mode of operation.

3. The convertible pack as defined in claim 1 including a member overlyingly secured to one of said front and rear walls, and a pair of relatively spaced slots in said last-mentioned member through which a strap can be threaded incident to utilizing said pack in at least one of the waist pack and day backpack modes of operation.

4. The convertible pack as defined in claim 1 including a member overlyingly secured to one of said front and rear walls, a pair of relatively spaced slots in said last-mentioned member through which a strap can be threaded incident to utilizing said pack in at least one of the waist pack and day backpack modes of operation, and another pair of relatively spaced slots in said last-mentioned member through which a strap can be threaded to lash an article against said last-mentioned member in the day backpack mode of operation.

5. The convertible pack as defined in claim 1 including a member overlyingly secured to one of said front and rear walls, a pair of relatively spaced slots in said last-mentioned member through which a strap can be threaded incident to utilizing said pack in at least one of the waist pack and day backpack modes of operation, another pair of relatively spaced slots in said last-mentioned member through which a strap can be threaded to lash an article against said last-mentioned member in the day backpack mode of operation, and said first-mentioned and another pair of slots are disposed in substantially transverse relationship to each other.

6. The convertible pack as defined in claim 1 including a member overlyingly secured to one of said front and rear walls, a pair of relatively spaced slots in said last-mentioned member through which a strap can be threaded incident to utilizing said pack in at least one of the waist pack and day backpack modes of operation, another pair of relatively spaced slots in said last-mentioned member through which a strap can be threaded to lash an article against said last-mentioned member in the day backpack mode of operation, and said first-mentioned and another pair of slots are disposed in substantially normal relationship to each other.

7. The convertible pack as defined in claim 1 wherein said hinge means is a fabric member spanning said bottom wall portion of said peripheral wall.

8. The convertible pack as defined in claim 1 wherein said hinge means is a fabric member spanning said bottom wall portion of said peripheral wall across a portion of said zipper means.

9. The convertible pack as defined in claim 1 wherein said hinge means is a fabric member spanning said bottom wall portion of said peripheral wall substantially medially of a pair of opposite end wall portions of said pack located between said bottom wall portion and a top wall portion of said peripheral wall.

10. The convertible pack as defined in claim 1 wherein said hinge means is a fabric member spanning said bottom wall portion of said peripheral wall across a portion of said zipper means substantially medially of a pair of opposite end wall portions of said pack located between said bottom wall portion and a top wall portion of said peripheral wall.

11. The convertible pack as defined in claim 1 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, and third zipper means for accessing said rear storage compartment in said day backpack mode of operation of said pack.

12. The convertible pack as defined in claim 1 including a partition wall between said front and rear walls separating said interior storage compartment into a front storage compartment and a rear storage compartment, second zipper means at least in the peripheral top wall portion for accessing said front storage compartment, a further wall disposed between said partition wall and an internal peripheral of said rear wall and defining therewith said rear storage compartment, third zipper means for accessing said rear storage compartment in said day backpack mode of operation of said pack, and a further compartment within said rear storage compartment.

13. The convertible pack as defined in claim 1 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, third zipper means for accessing said rear storage compartment in said day backpack mode of operation of said pack, and a further compartment within said front storage compartment.

14. The convertible pack as defined in claim 1 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, third zipper means for accessing said rear storage compartment in said day backpack mode of operation of said pack, and a further compartment within each of said front and rear storage compartments.

15. The convertible pack as defined in claim 1 including means internally of said strap means for strengthening the same.

16. The convertible pack as defined in claim 1 including cable means internally of said strap means for strengthening the same.

17. The convertible pack as defined in claim 1 including stainless steel cable means internally of said strap means for strengthening the same.

18. The convertible pack as defined in claim 1 wherein said peripheral wall includes a top wall portion and spaced opposite end wall portions disposed between said top wall portion and said bottom wall portion, coupling means for connecting a strap end to each of said end wall portions, security means for preventing unauthorized access to said coupling means thereby deterring theft of said pack in the shoulder bag mode of operation, and said security means is a fabric security member sewn to each of said end wall portions.

19. The convertible pack as defined in claim 1 wherein said peripheral wall includes a top wall portion and spaced opposite end wall portions disposed between said top wall portion and said bottom wall portion, coupling means for connecting a strap end to each of said end wall portions, security means for preventing unauthorized access to said coupling means thereby deterring theft of said pack in the shoulder bag mode of operation, said security means is a fabric security member sewn to each of said end wall portions, and each fabric security member and its associated end wall portion defines an upwardly facing opening into which a strap end coupling member can be inserted for connecting to an associated one of said coupling means.

20. The convertible pack as defined in claim 2 including a member overlyingly secured to one of said front and rear walls, and a pair of relatively spaced slots in said last-mentioned member through which a strap can be threaded incident to utilizing said pack in at least one of the waist pack and day backpack modes of operation.

21. The convertible pack as defined in claim 2 including a member overlyingly secured to one of said front and rear walls, a pair of relatively spaced slots in said last-mentioned member through which a strap can be threaded incident to utilizing said pack in at least one of the waist pack and day backpack modes of operation, and another pair of relatively spaced slots in said last-mentioned member through which a strap can be threaded to lash an article against said last-mentioned member in the day backpack mode of operation.

22. The convertible pack as defined in claim 2 wherein said hinge means is a fabric member spanning said bottom wall portion of said peripheral wall.

23. The convertible pack as defined in claim 2 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, and third zipper means for accessing said rear storage compartment in said day backpack mode of operation of said pack.

24. The convertible pack as defined in claim 11 including a member overlyingly secured to one of said front and rear walls, and a pair of relatively spaced slots in said last-mentioned member through which a strap can be threaded incident to utilizing said pack in at least one of the waist pack and day backpack modes of operation.

25. The convertible pack as defined in claim 11 wherein said hinge means is a fabric member spanning said bottom wall portion of said peripheral wall.

26. The convertible pack as defined in claim 11 wherein said hinge means is a fabric member spanning said bottom wall portion of said peripheral wall substantially medially of a pair of opposite end wall portions of said pack located between said bottom wall portion and a top wall portion of said peripheral wall.

27. The convertible pack as defined in claim 18 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, and third zipper means for accessing said rear storage compartment in said day backpack mode of operation of said pack.

28. The convertible pack as defined in claim 19 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, and third zipper means for accessing said rear storage compartment in said day backpack mode of operation of said pack.

29. The convertible pack as defined in claim 19 including a member overlyingly secured to one of said front and rear walls, and a pair of relatively spaced slots in said last-mentioned member through which a strap can be threaded incident to utilizing said pack in at least one of the waist pack and day backpack modes of operation.

30. A day backpack comprising front and rear walls and a peripheral wall joining said front and rear walls, said walls in part defining an interior storage compartment, said peripheral wall including a bottom wall portion, zipper means for opening and closing said peripheral wall substantially along the entire peripheral extent thereof, means at a central portion of said bottom wall portion for hinging together said front and rear walls, said hinge means being constructed and arranged to function as a weight bearing support during the use of the day backpack, and shoulder strap means accessible upon opening said peripheral wall by said zipper means for supporting said day backpack in use.

31. The day backpack as defined in claim 30 wherein said hinge means is a fabric member spanning said bottom wall portion of said peripheral wall.

32. The day backpack as defined in claim 30 wherein said hinge is a fabric member spanning said bottom wall portion of said peripheral wall across a portion of said zipper means.

33. The day backpack as defined in claim 30 wherein said hinge means is a fabric member spanning said bottom wall portion of said peripheral wall substantially medially of a pair of opposite end wall portions of said day backpack located between said bottom wall portion and a top wall portion of said peripheral wall.

34. The day backpack as defined in claim 30 wherein said hinge means is a fabric member spanning said bottom wall portion of said peripheral wall across a portion of said zipper means substantially medially of a pair of opposite end wall portions of said day backpack located between said bottom wall portion and a top wall portion of said peripheral wall.

35. The day backpack as defined in claim 30 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, and third zipper means for accessing said rear storage compartment.

36. The day backpack as defined in claim 35 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, and a further compartment within said rear storage compartment.

37. The day backpack as defined in claim 35 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral of said rear wall and defining therewith said rear storage compartment, third zipper means for accessing said rear storage compartment, and a further compartment within said front storage compartment.

38. The day backpack as defined in claim 30 including a partition wall between said front and rear walls separating said interior storage compartment into a front storage compartment and a rear storage compartment, second zipper means at least in the peripheral wall top wall portion for accessing said front storage compartment, a further wall disposed between said partition wall and an internal peripheral od said rear wall and defining therewith said rear storage compartment, third zipper means for accessing said rear storage compartment, and a further compartment within each of said front and rear storage compartments.

39. A waist pack comprising front and rear walls and a peripheral wall joining said front and rear walls, said walls in part defining an interior storage compartment, said peripheral wall including a bottom wall portion, zipper means for opening and closing said peripheral wall substantially along at least a portion of the peripheral extent thereof, said peripheral wall further includes a top wall portion and spaced opposite end wall portions disposed between said top wall portion and said bottom wall portion, coupling means for connecting a strap end to each of said end wall portions, and security means for preventing unauthorized access to said coupling means thereby deterring theft of said pack in the shoulder bag mode of operation.

40. The waist pack as defined in claim 39 including a member overlyingly secured to one of said front and rear walls, and a pair of relatively spaced slots in said last-mentioned member through which a strap can be threaded incident to utilizing said waist pack.

41. The waist pack as defined in claim 39 wherein said security means is a fabric security member sewn to each of said end wall portions.

42. The waist pack as defined in claim 39 wherein said security means is a fabric security member sewn to each of said end wall portions, and each fabric security member and its associated end wall portion defines an upwardly facing opening into which a strap end coupling member can be inserted for connecting to an associated one of said coupling means.

43. A waist pack comprising front and rear walls and a peripheral wall joining said front and rear walls, said walls in part defining an interior storage compartment, said peripheral wall including a bottom wall portion, zipper means for opening and closing said peripheral wall substantially along at least a portion of the peripheral extent thereof, said peripheral wall further includes a top wall portion and spaced opposite end wall portions disposed between said top wall portion and said bottom wall portion, coupling means for connecting a strap end to each of said end wall portions, a member overlyingly secured to one of said front and rear walls, and a pair of relatively spaced slots in said last-mentioned member through which a strap can be threaded incident to utilizing said waist pack.

44. A waist pack comprising front and rear walls and a peripheral wall joining said front and rear walls, said walls in part defining an interior storage compartment, said peripheral wall including a bottom wall portion, zipper means for opening and closing said peripheral wall substantially along at least a portion of the peripheral extent thereof, said peripheral wall further includes a top wall portion and spaced opposite end wall portions disposed between said top wall portion and said bottom wall portion, coupling means for connecting a strap end to each of said end wall portions, a member overlyingly secured to one of said front and rear walls, a pair of relatively spaced slots in said last-mentioned member through which a strap can be threaded incident to utilizing said waist pack, and another pair of relatively space slots in said last-mentioned member through which a strap can be threaded to lash an article against said last-mentioned member.

45. A waist pack comprising front and rear walls and a peripheral wall joining said front and rear walls, said walls in part defining an interior storage compartment, said peripheral wall including a bottom wall portion, zipper means for opening and closing said peripheral wall substantially along at least a portion of the peripheral extent thereof, said peripheral wall further includes a top wall portion and spaced opposite end wall portions disposed between said top wall portion and said bottom wall portion, coupling means for connecting a strap end to each of said end wall portions, a member overlyingly secured to one of said front and rear walls, a pair of relatively spaced slots in said last-mentioned member through which a strap can be threaded incident to utilizing said waist pack, another pair of relatively spaced slots in said last-mentioned member through which a strap can be threaded to lash an article against said last-mentioned member, and said first-mentioned and another pair of slots are disposed in substantially transverse relationship to each other.

46. A waist pack comprising front and rear walls and a peripheral wall joining said front and rear walls, said walls in part defining an interior storage compartment, said peripheral wall including a bottom wall portion, zipper means for opening and closing said peripheral wall substantially along at least a portion of the peripheral extent thereof, said peripheral wall further includes a top wall portion and spaced opposite end wall portions disposed between said top wall portion and said bottom wall portion, coupling means for connecting a strap end to each of said end wall portions, a member overlyingly secured to one of said front and rear walls, a pair of relatively spaced slots in said last-mentioned member through which a strap can be threaded incident to utilizing said waist pack, another pair of relatively spaced slots in said last-mentioned member through which a strap can be threaded to lash an article against said last-mentioned member, and said first-mentioned and another pair of slots are disposed in substantially normal relationship to each other.

* * * * *